US011565529B2

(12) United States Patent
Meisner et al.

(10) Patent No.: US 11,565,529 B2
(45) Date of Patent: Jan. 31, 2023

(54) DEHUMIDIFIER CONDENSING UNIT FOR AN INKJET PRINTER

(71) Applicant: Hewlett-Packard Development Company, L.P., Spring, TX (US)

(72) Inventors: Nicholas J Meisner, Corvallis, OR (US); Joe Santich, Corvallis, OR (US); Robert K Saathoff, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 391 days.

(21) Appl. No.: 16/615,712

(22) PCT Filed: Jun. 21, 2017

(86) PCT No.: PCT/US2017/038573
§ 371 (c)(1),
(2) Date: Nov. 21, 2019

(87) PCT Pub. No.: WO2018/236370
PCT Pub. Date: Dec. 27, 2018

(65) Prior Publication Data

US 2020/0180317 A1 Jun. 11, 2020

(51) Int. Cl.

| | |
|---|---|
| ***B41J 2/17*** | (2006.01) |
| ***B41J 2/175*** | (2006.01) |
| ***B41J 29/02*** | (2006.01) |
| ***B41J 29/13*** | (2006.01) |
| ***B41J 29/377*** | (2006.01) |

(52) U.S. Cl.
CPC ..... *B41J 2/1714* (2013.01); *B41J 2/175* (2013.01); *B41J 29/02* (2013.01); *B41J 29/13* (2013.01); *B41J 29/377* (2013.01)

(58) Field of Classification Search
CPC . B41J 2/1714; B41J 2/175; B41J 29/02; B41J 29/13; B41J 29/377; B41J 2/18
USPC ..... 96/108
See application file for complete search history.

(56) References Cited

U.S. PATENT DOCUMENTS

| | | | | |
|---|---|---|---|---|
| 8,226,224 | B2 | 7/2012 | Hanson et al. | |
| 9,248,666 | B2 | 2/2016 | Fuchioka et al. | |
| 2004/0060808 | A1* | 4/2004 | LaViolette | F24S 10/25 203/1 |
| 2005/0093908 | A1* | 5/2005 | Riou | B41J 29/377 347/18 |

(Continued)

FOREIGN PATENT DOCUMENTS

| | | | |
|---|---|---|---|
| EP | 1385591 | B1 | 3/2007 |
| EP | 2087305 | B1 | 7/2016 |

(Continued)

OTHER PUBLICATIONS

HP Latex Printing Technologies, Apr. 2010 v.2, Available online at: < http://www.hp.com/hpinfo/newsroom/press_kits/2010/IPEX2010/TechNotable_LatexPrinting.pdf >.

*Primary Examiner* — Kristal Feggins
*Assistant Examiner* — Alexander D Shenderov

(57) ABSTRACT

In one example, a dehumidifier for an inkjet printer includes a condensing unit and a chiller to circulate coolant through the condensing unit. The condensing unit is made of a thermally conductive material forming elongated exterior condensing surfaces and an interior coolant flow passage extending lengthwise between the condensing surfaces.

19 Claims, 7 Drawing Sheets

(56) References Cited

U.S. PATENT DOCUMENTS

| | | | | |
|---|---|---|---|---|
| 2013/0215203 | A1 | 8/2013 | Chen | |
| 2013/0293621 | A1* | 11/2013 | Tunmore | B41J 2/0458 347/17 |
| 2017/0057250 | A1 | 3/2017 | Bastardas et al. | |

FOREIGN PATENT DOCUMENTS

| | | | |
|---|---|---|---|
| JP | 2010125828 | A | 6/2010 |
| JP | 2010143007 | A | 7/2010 |

* cited by examiner

DEHUMIDIFIER CONDENSING UNIT FOR AN INKJET PRINTER

BACKGROUND

In large commercial inkjet web printers, commonly referred to as inkjet web presses, a continuous web moves past a series of stationary inkjet printheads that dispense ink on to the moving web.

DRAWINGS

The same part numbers designate the same or similar parts throughout the figures. The figures are not necessarily to scale.

DESCRIPTION

High speed inkjet web printing presses using water based inks generate a large amount of moisture. Moisture in the air near the print substrate can condense on the printheads and other surfaces in and around the print zone. Condensation can degrade print quality, for example by impeding the ejection of ink drops from the nozzles in the printheads and by dripping water on to the print substrate. The volume of potentially damaging water condensation can be substantial. For example, an inkjet web press printing water based inks may produce unwanted condensation at a rate of 1 liter per hour or more. Preventing or removing condensation in inkjet web presses is particularly difficult because of the volume of excess moisture generated and due to the small spaces available near the print zone for condensation control.

A new dehumidifier has been developed for use in commercial inkjet printing presses and other high speed inkjet printers to help remove excess moisture generated during printing. In one example, a dehumidifier includes multiple condensing units each with thermally conductive exterior condensing surfaces and an interior flow passage extending lengthwise between the condensing surfaces. This configuration enables the use of long, narrow condensing surfaces on thin condensing units to fit in small spaces between adjacent print bars in an inkjet web press. The dehumidifier also includes a chiller to circulate coolant through the flow passages. The condensing units and the chiller may be scaled up or down to develop the desired condensing capacity for a particular printing environment. For example, for an inkjet web press in which the space between print bars allows a condensing unit that is just 1.5 cm thick, it is expected that an aluminum condensing unit with a hydrophobic material coating that provides an effective condensing surface area of at least 340 $cm^2$ can condense 5 ml or more of water per minute. A dehumidifier with four such condensing units, for example, operating with a 500 W chiller may remove up to 20 ml of water per minute (1.2 l per hour) from the print zone.

These and other examples described herein illustrate but do not limit the scope of the patent, which is defined in the Claims following this Description.

As used in this document, "length" and "lengthwise" when referring to a condensing unit means the long dimension of the unit.

Figure 1:
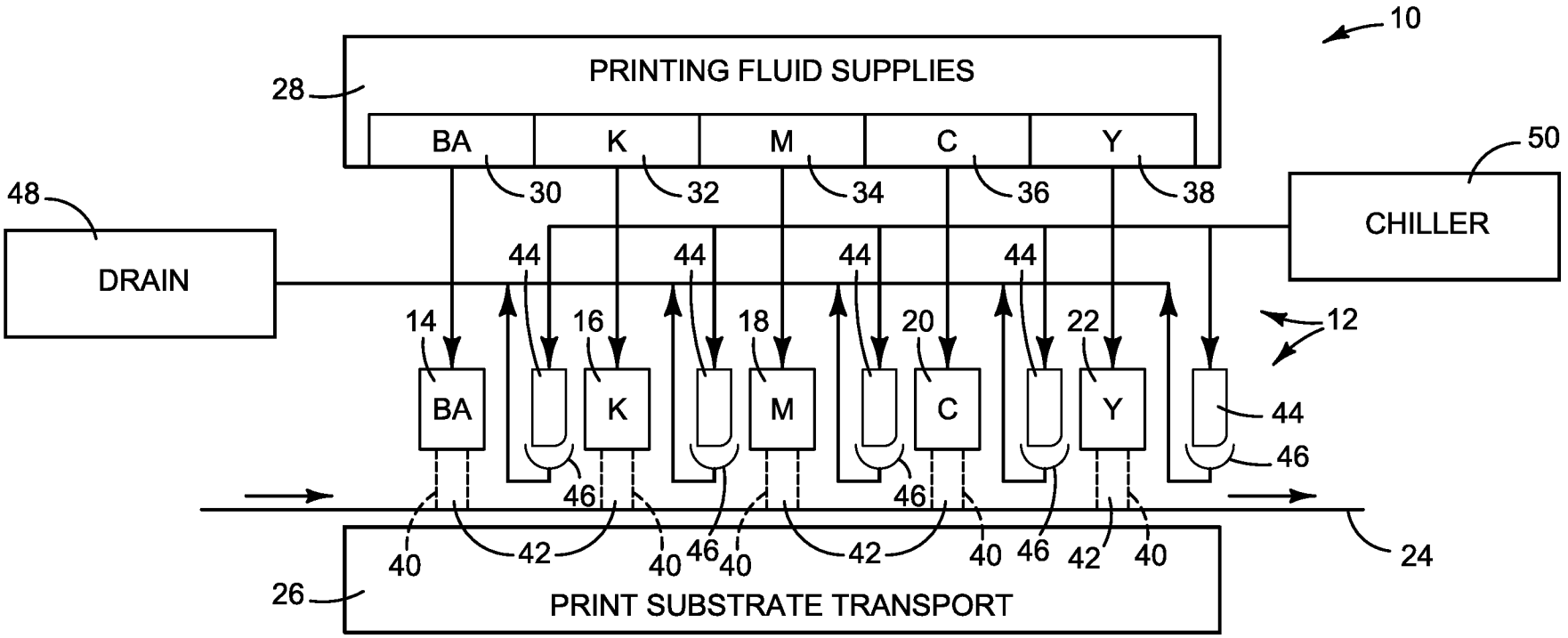
FIG. 1 illustrates an inkjet printer implementing one example of a dehumidifier.

FIG. 1 illustrates an inkjet printer 10 implementing one example of a dehumidifier 12. Referring to FIG. 1, printer 10 includes dehumidifier 12, print bars 14, 16, 18, 20, and 22 spanning the width of a print substrate 24, a print substrate transport 26 and a supply 28 of printing fluids 30, 32, 34, 36, and 38. Each print bar 14-22 usually will include multiple printheads or printhead modules to dispense printing fluids 30-38 on to print substrate 24, for example as drops or streams 40, as substrate 24 moves through a print zone 42 past each print bar 14-22 at the urging of transport 26. The printing fluids may include, for example, a bonding agent (BA) 30, black ink (K) 32, magenta ink (M) 34, cyan ink (C) 36, and yellow ink (Y) 38.

Dehumidifier 12 includes condensing units 44, a gutter 46 below each condensing unit 44, a drain 48, and a chiller 50. In this example, each condensing unit 44 is positioned downstream from a respective print bar 14-22. A condensing unit 44 is positioned between each pair of adjacent print bars 14/16, 16/18, 18/20, and 20/22. As described in more detail below with reference to the example shown in FIGS. 3-6, each condensing unit 44 includes exterior condensing surfaces that extend lengthwise between adjacent print bars (or along a single print bar) and an interior flow passage between the condensing surfaces. Chiller 50 circulates coolant through the flow passage in each condensing unit 44 to cool the condensing surfaces. Condensation from each unit 44 collects in a respective gutter 46 and drains to drain 48.

Figure 2:
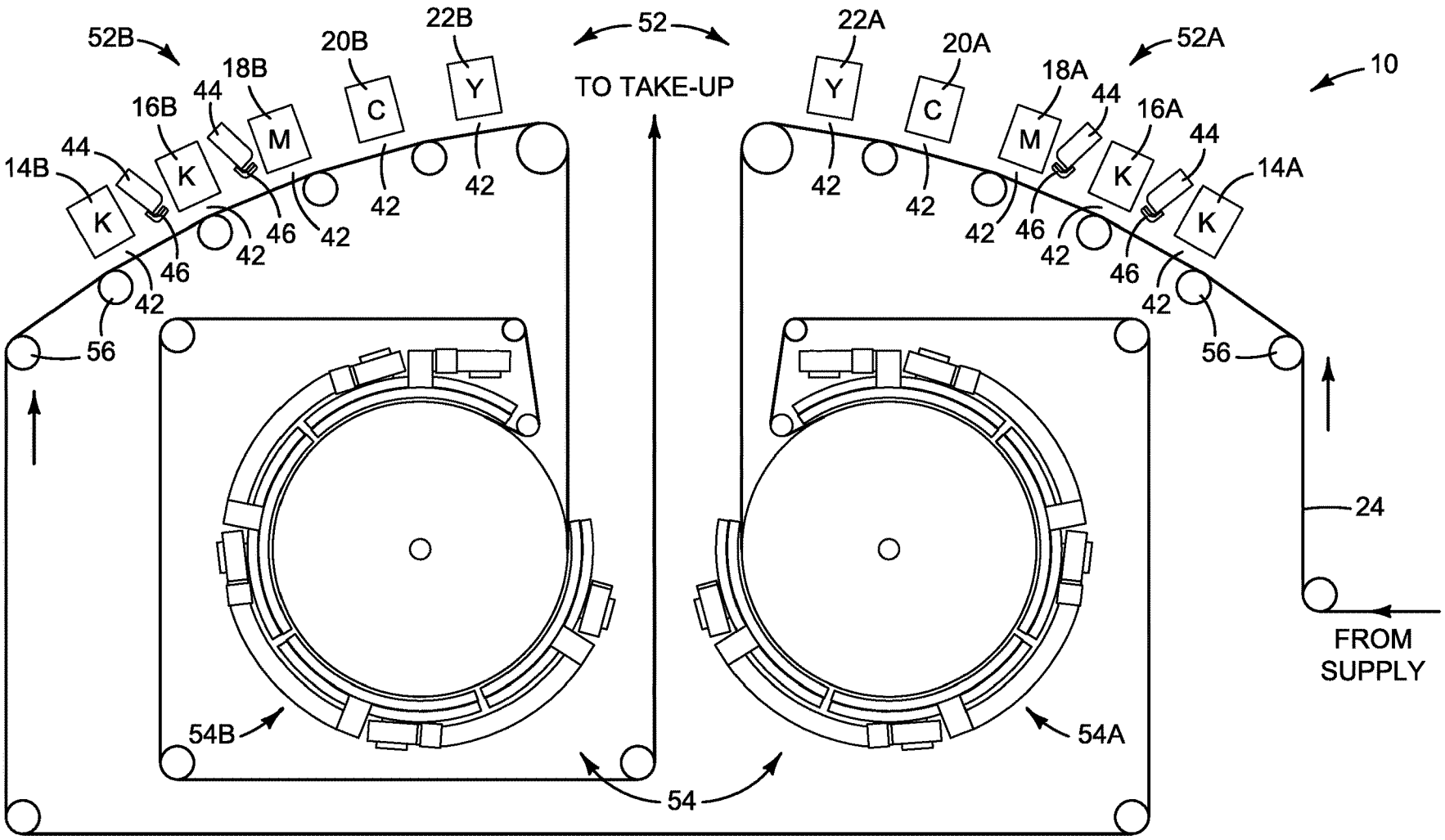
FIG. 2 illustrates an inkjet web printer implementing one example arrangement for condensing units in a dehumidifier.

FIG. 2 illustrates an inkjet web printer 10 implementing one example arrangement for dehumidifier condensing units 44 in an arched printing unit 52. Referring to FIG. 2, printer 10 includes a web supply (not shown) from which a print substrate web 24 is fed to printing unit 52 along rollers 56, and a web take-up (not shown) to which web 24 is taken after passing through printing unit 52. Printer 10 also includes a dryer 54 positioned under and contained within the footprint of arched printing unit 52.

In this example, arched printing unit 52 includes a first printing unit 52A for printing on one side of web 24 and a second printing unit 52B for printing on the other side of web 24. First printing unit 52A includes a first series of print bars 14A-22A arranged along an arc on one side of arched printing unit 52. Second printing unit 52B includes a second series of print bars 14B-22B arranged along an arc on the other side of arched printing unit 52. In one example, the printheads on print bars 14A-22A and 14B-22B dispense a black (K) ink, black (K) ink, magenta (M) ink, cyan (C) ink, and yellow (Y) ink, respectively. Also in this example, dryer 54 includes a first dryer 54A for drying one side of web 24 and a second dryer 54B for drying the other side of web 24. In the example arrangement shown in FIG. 2, a condensing unit 44 is positioned downstream from each black (K) print bar 14A, 14B, 16A, 16B. This arrangement may be desirable, for example, in printing applications with a higher volume of monochrome printing in which much of the moisture is generated in print zones near K print bars 14A, 14B, 16A, 16B. Other suitable arrangements are possible. For example, in a duplexing web printer 10 such as that shown in FIG. 2, much of the condensation may be generated printing the second side of the print substrate 24, in the second printing unit 52B in FIG. 2. Thus, it may be desirable in some printing applications to locate more (or even all) of the condensing units 44 near the print bars in the duplexing part of the printer.

Figure 3:
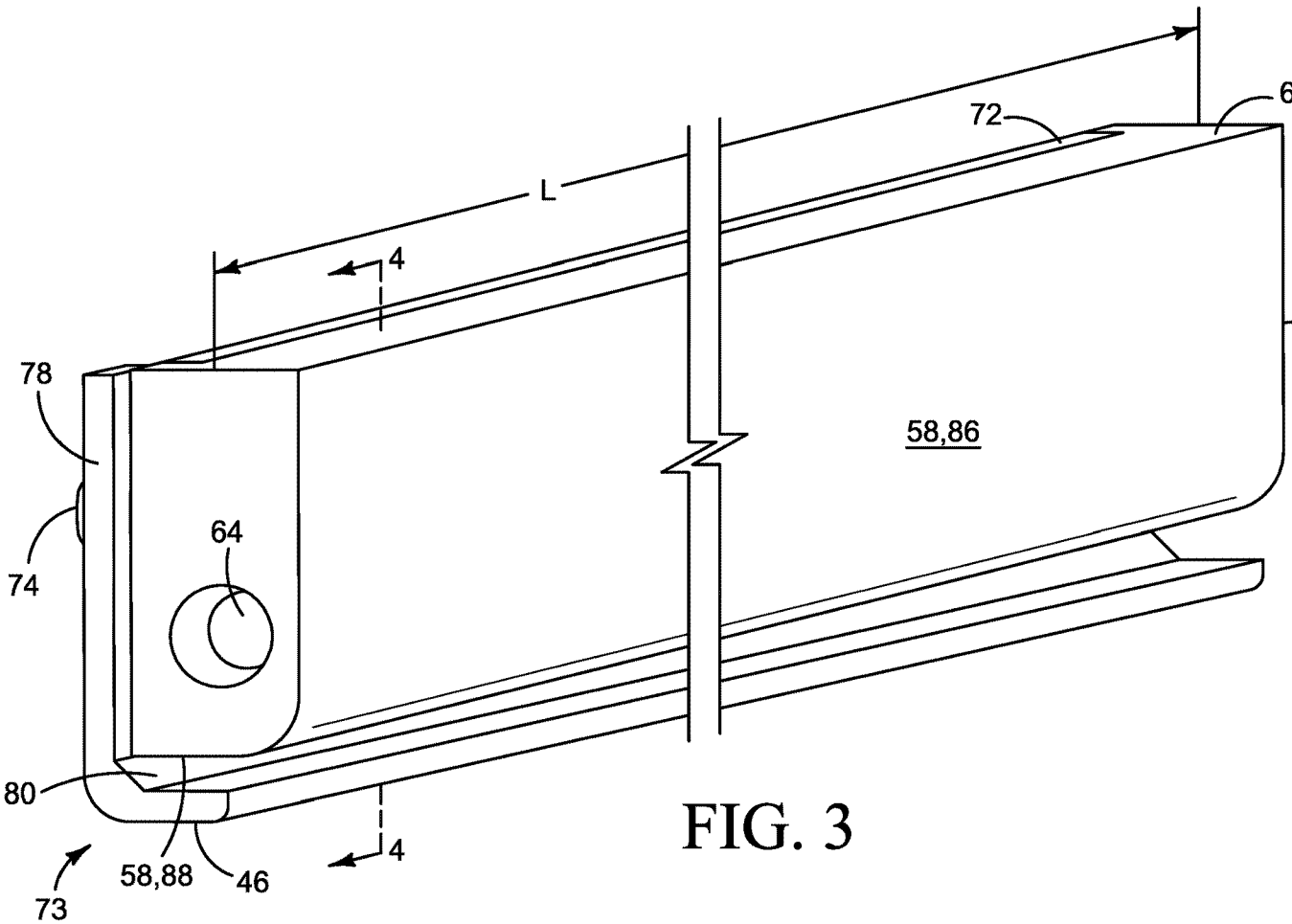
FIGS. 3 and 4 are isometric and section views, respectively, illustrating one example of a condensing unit for a dehumidifier, such as might be used in the arrangement shown FIG. 2.
Figure 4:
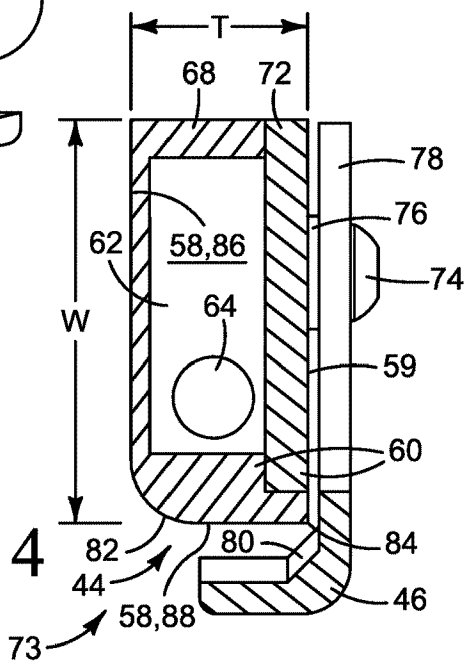
Figure 5:
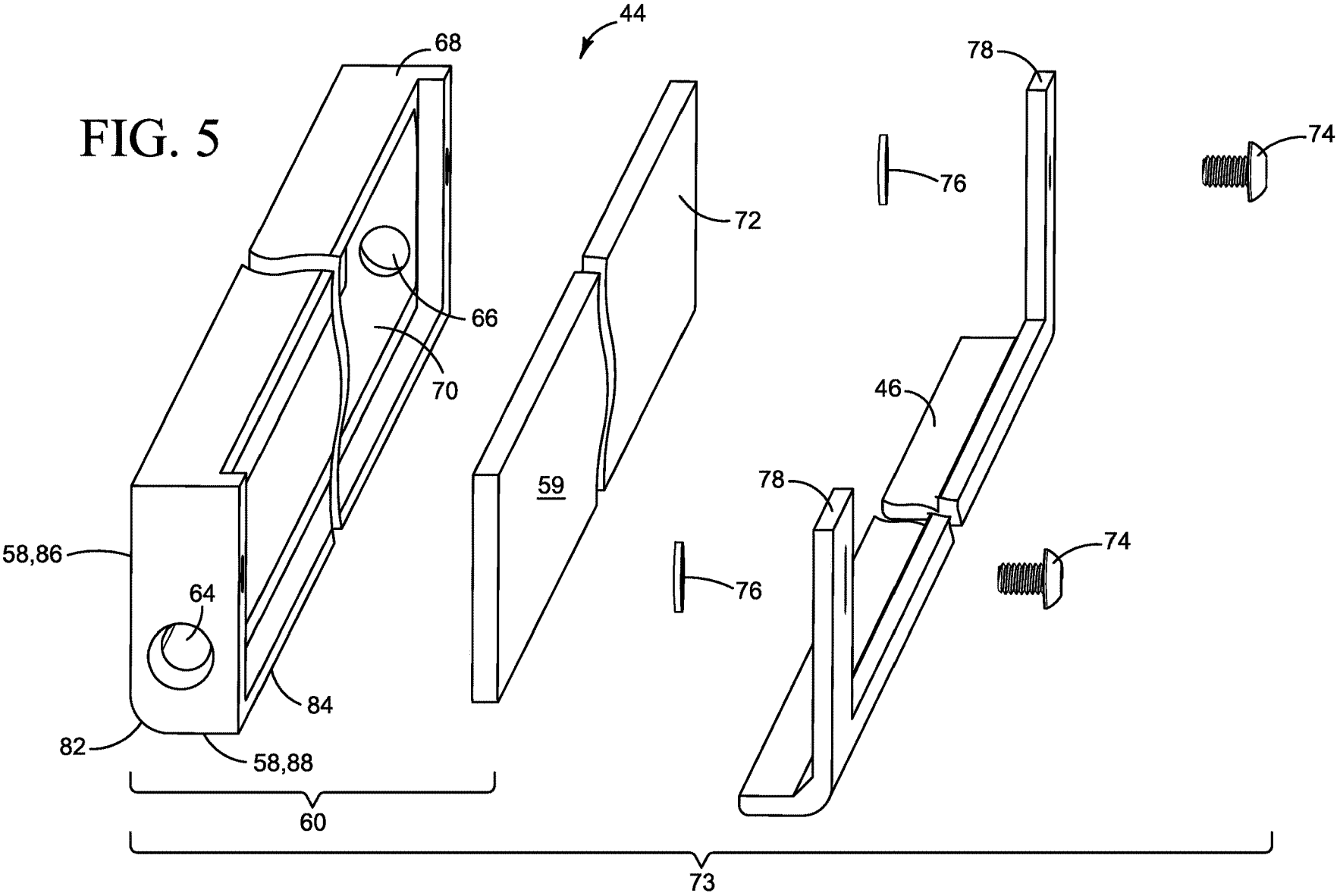
FIG. 5 is an exploded view of the example condensing unit shown in FIGS. 3 and 4.
Figure 6:
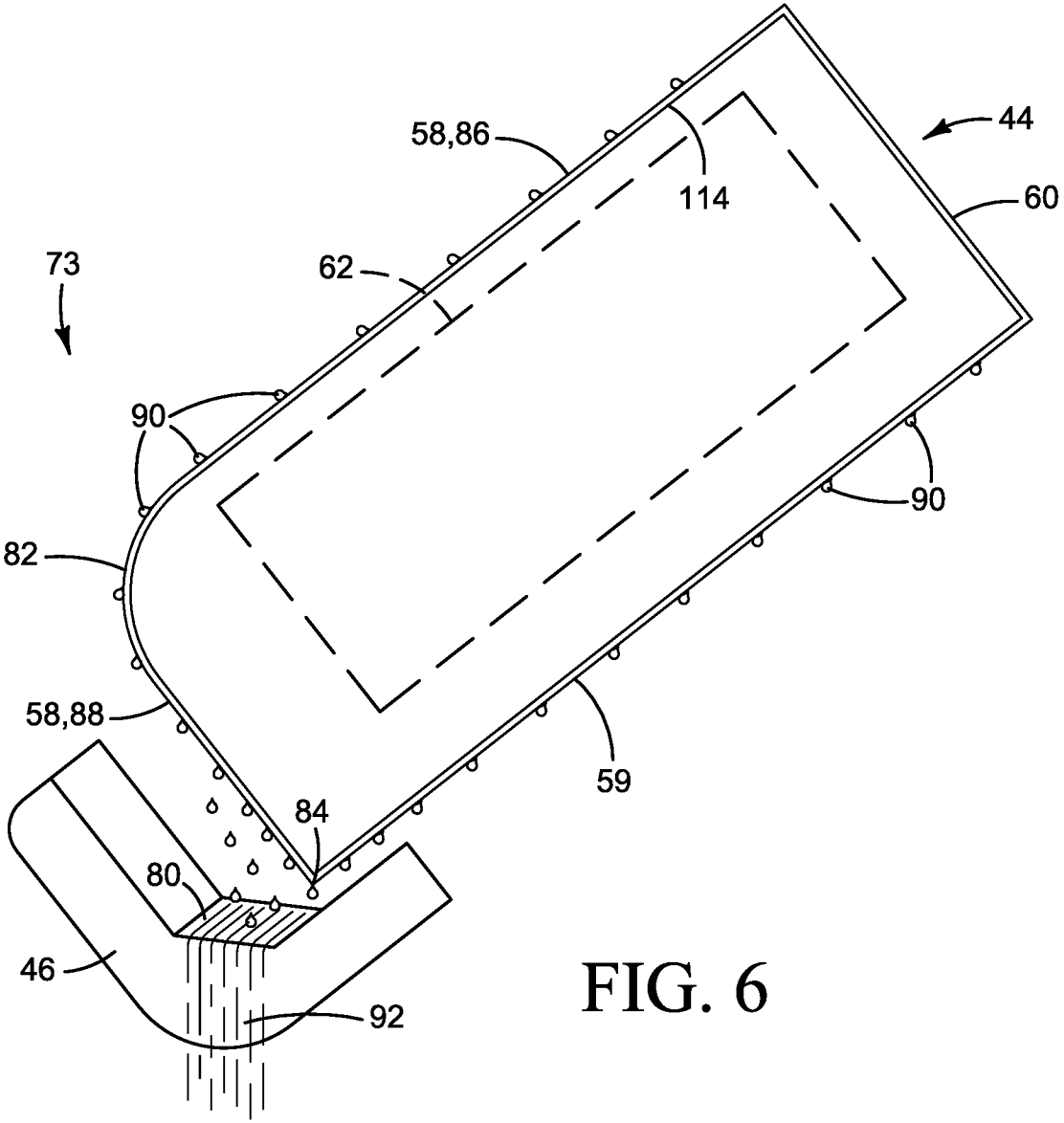
FIG. 6 is a detail showing water droplets on the condensing surfaces and collecting in the gutter in the example condensing unit shown in FIGS. 3-5.

FIGS. 3-5 illustrate one example of a condensing unit 44 and gutter 46 for a dehumidifier 12 in FIG. 1, such as might be used in the arrangement shown in FIG. 2. FIG. 6 is a detail showing condensation from a unit 44 in FIGS. 3-5 collecting in gutter 46. Referring to FIGS. 3-6, condensing unit 44 includes condensing surfaces 58 and 59 along the exterior of an elongated, generally rectangular housing 60 made of aluminum or another suitable thermally conductive material. An interior flow passage 62 through housing 60 extends lengthwise between condensing surfaces 58, 59. Coolant enters flow passage 62 through an inlet 64 at one end of housing 60. Coolant leaves flow passage 62 through an outlet 66 at the other end of housing 60. In this example, as best seen in FIG. 5, condenser housing 60 is configured as a body 68 with a cavity 70 and a cover 72 affixed to body 68 covering cavity 70, to form flow passage 62. Other suitable configurations are possible for condenser housing 60. For another example, it may be possible (and desirable) to machine, mold or otherwise manufacture a housing 60 with a flow passage 62 in a single part.

In this example, gutter 46 is mounted to condensing unit 44 to form a condensing unit module 73, for example with fasteners 74 and spacers 76 at gutter end brackets 78. Gutter 46 is spaced apart from condensing surface 59 a distance sufficient to allow condensation to run down surface 59 and fall unimpeded into the trough 80 of gutter 46 and to help insulate gutter 16 from the cooler condensing surfaces 58, 59 so that water will not condense on the bottom surface of gutter 16. Also in this example, as best seen in FIG. 3, gutter 46 slopes away from condenser unit 44 lengthwise from end to end to allow water to drain to one end of the gutter even when the condensing unit is oriented horizontally in a printer.

In the example shown in FIGS. 3-6, condensing surface 58 transitions along a rounded corner 82 before intersecting condensing surface 59 along a sharp corner 84. That is to say, a broad face 86 of condensing surface 58 across the width W of housing 60 transitions gently along a curve 82 to a narrow face 88 across the thickness T of housing 60, while condensing surface 59 ends abruptly along an edge 84. Condensation is depicted by droplets 90 in FIG. 6. Condensation draining off the low end of gutter 46 is depicted by a water fall 92 in FIG. 6.

The configuration of condensing surfaces 58, 59 shown in FIGS. 3-6 may be desirable, for example, where condensing unit 44 is oriented in the printer at a diagonal to channel the flow of condensation to a single drip edge 84, where it may fall into gutter 46. This configuration helps channel condensation along surfaces 58, 59 more effectively to gutter 46 and it enables a smaller gutter footprint without shrinking the thickness T of housing 60 to maintain the desired size and capacity of flow passage 62. A rounded corner 82 (along with a rounded bottom on gutter 46) may also help draw moisture laden air up from the surface of the print substrate and along condensing surfaces 58, 59 to increase the rate of condensation. A thin coating of Nanoslic NS-200 or another suitably hydrophobic material on condensing surfaces 58, 59 may also increase the rate of condensation. FIG. 6 shows condensing surfaces 58, 59 on a hydrophobic coating 114.

Figure 7:
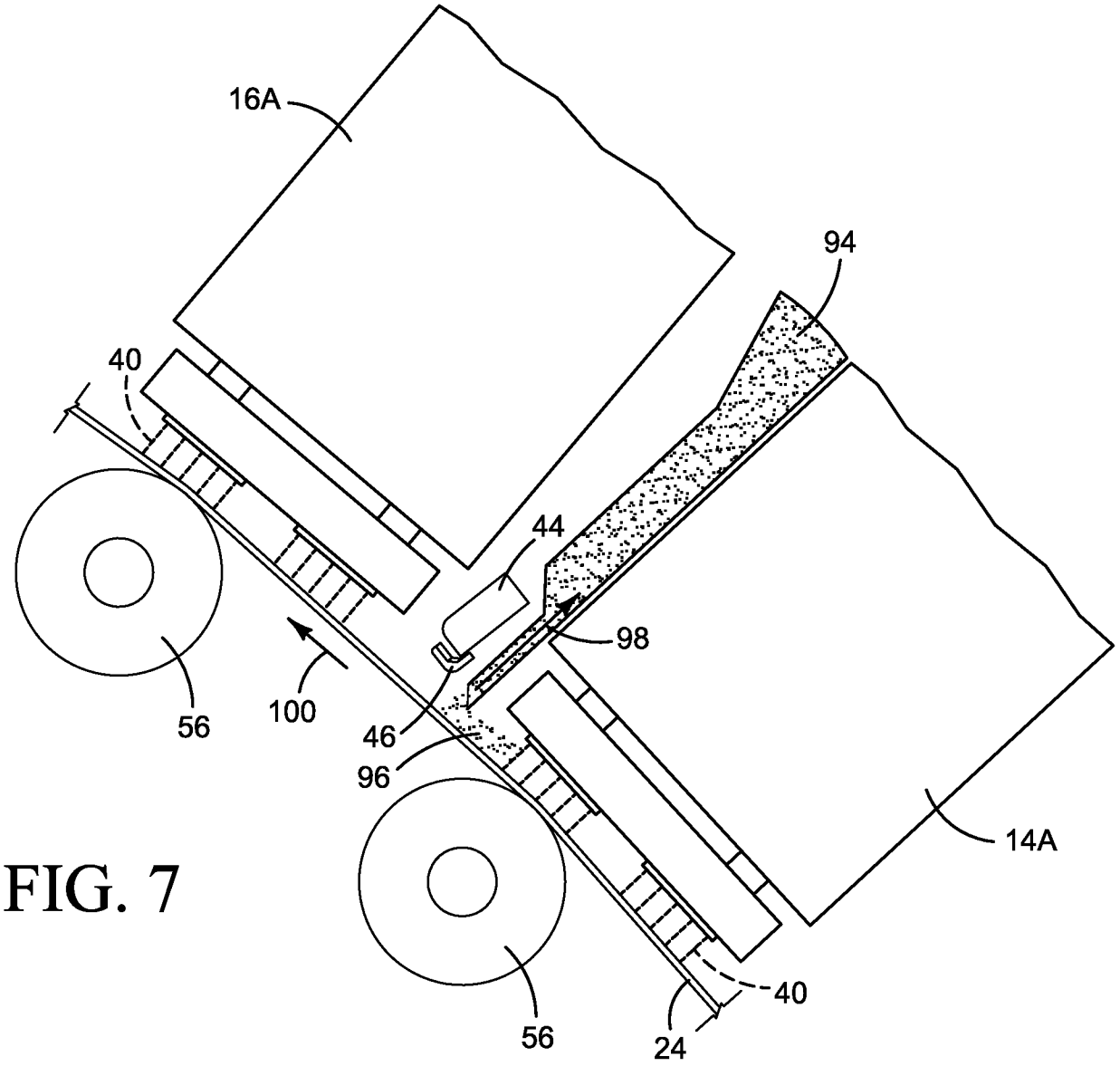
FIG. 7 is a detail illustrating an example implementation for a condensing unit such as the unit shown in FIG. 6 in an inkjet web printer.

FIG. 7 is a detail illustrating an example implementation for a condensing unit 44, such as the one shown in FIG. 6, in an inkjet web printer with a vacuum duct 94 between adjacent print bars 14A and 16A. Referring to FIG. 7, the moving web 24 can entrain ink and other printing fluid aerosol 96. Aerosol 96 carried along web 24 may interfere with the performance of downstream printheads. Accordingly, some inkjet web printers include an aerosol control system with a vacuum duct 94 downstream from each print bar to suck up aerosol 96 near the print zone, as indicated by flow arrow 98 in FIG. 7. (The direction of movement of print substrate web 24 is indicated by arrow 100.) Although an aerosol control system with vacuum ducts 94 may help remove some of the moisture generated in the print zone, it does not significantly reduce excess condensation.

In one example implementation for an inkjet web printer with vacuum ducts, with a configuration such as that shown in FIG. 7, an aluminum condensing unit 44 that is about 5 cm wide and less than 1.5 cm thick, with a hydrophobic condensing surface area of at least 340 $cm^2$ and a coolant flow capacity of at least 1,000 ml per minute to keep the condensing surfaces at a temperature in the range of 15° C. to 20° C., may be used to condense 5 ml or more water per minute. A dehumidifier with four such condensing units operating with a 500 W chiller may remove 20 ml water per minute (1.2 l per hour) from the print zones.

Figure 8:
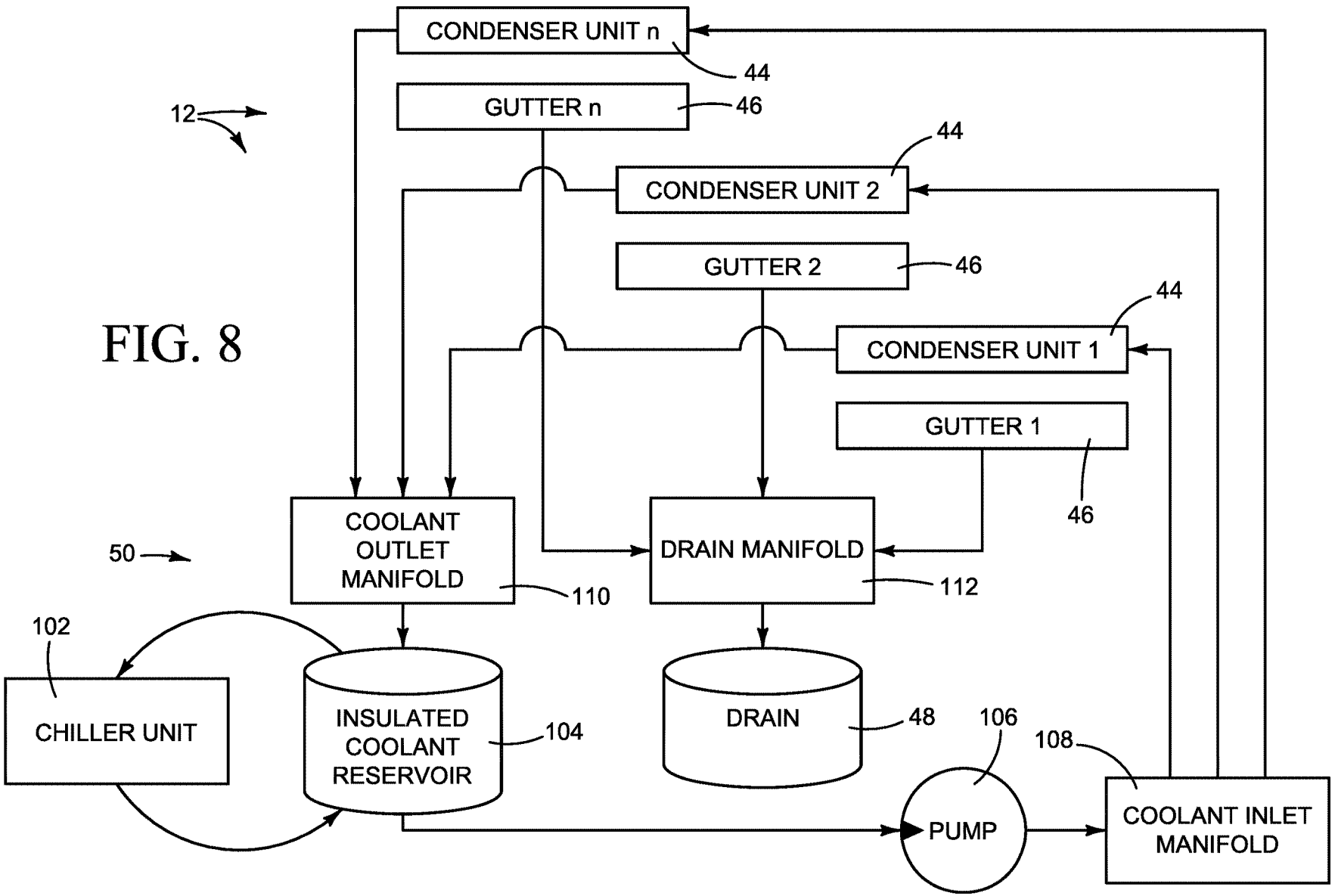
FIG. 8 is a block diagram illustrating one example of a dehumidifier for an inkjet printer implementing multiple condensing units.

FIG. 8 is a block diagram illustrating one example of a dehumidifier 12 for an inkjet printer, implementing multiple condensing units 44 such as the example condensing unit shown in FIGS. 3-6. Referring to FIG. 8, dehumidifier 12 includes n condensing units 44, n gutters 46 each associated with a condensing unit 44, and a chiller 50. While any suitable chiller may be used, in the example shown in FIG. 8, chiller 50 includes a chiller unit 102, an insulated coolant reservoir 104 operatively connected to chiller unit 102, and a pump 106 to circulate coolant to condensing units 44. In this example, dehumidifier 12 also includes an inlet manifold 108 to distribute coolant to each condensing unit 44 and an outlet manifold 110 to collect coolant from each condensing unit 44 for return to reservoir 104. Dehumidifier 12 may also include a drain manifold 112 to collect condensate from each gutter 46, for example through individual drains, for accumulation in a central drain or condensate reservoir 48.

As noted at the beginning of this Description, the examples shown in the figures and described above illustrate but do not limit the scope of the patent. Other examples are possible. Therefore, the foregoing description should not be construed to limit the scope of the patent, which is defined in the following Claims.

"A" and "an" as used in the Claims means one or more.

The invention claimed is:

1. A dehumidifier for an inkjet printer, comprising:

a condensing unit including:

thermally conductive material forming elongated exterior condensing surfaces and an interior flow passage extending lengthwise between the exterior condensing surfaces, the exterior condensing surfaces converging at a low point along a sharp corner;

an inlet to the flow passage through which coolant may enter the unit; and an outlet from the flow passage through which coolant may leave the unit; and a chiller to circulate a coolant through the flow passage; and where the condensing unit and the chiller have a capacity sufficient to condense at least 5 ml of water per minute on the exterior condensing surfaces.

2. The dehumidifier of claim 1, where the condensing unit comprises multiple condensing units each including thermally conductive material defining elongated exterior condensing surfaces and an interior flow passage extending lengthwise between the exterior condensing surfaces, an inlet to the flow passage through which coolant may enter the unit, and an outlet from the flow passage through which coolant may leave the unit.

3. The dehumidifier of claim 2, where:

each condensing unit is less than 1.5 cm thick; and each exterior condensing surface is not more than 5 cm wide and has an area of at least 340 $cm^2$.

4. The dehumidifier of claim 3, where:

each flow passage has a volume sufficient to pass coolant at a rate of at least 1000 ml per minute; and the chiller is to keep each exterior condensing surface at a temperature in the range of 15° C. to 20° C.

5. The dehumidifier of claim 4, where the chiller has a capacity of at least 500 W.

6. The dehumidifier of claim 1, where a first one of the exterior condensing surfaces transitions along a rounded corner before intersecting a second one of the exterior condensing surfaces at the sharp corner.

7. The dehumidifier of claim 6, where a broad face of the first one of the exterior condensing surfaces across a width of the condensing unit transitions along the rounded corner to a narrow face across a thickness of the condensing unit.

8. An arched printing unit for an inkjet printer, comprising:

multiple inkjet print bars arranged along an arc to apply water based ink to a print substrate web; and a dehumidifier that includes:

multiple condensing units each positioned between adjacent print bars, each condensing unit having thermally conductive material forming exterior condensing surfaces at least partially enclosing an interior flow passage; and a chiller to circulate coolant through the flow passages to cool the exterior condensing surfaces and cause moisture to condense on the exterior condensing surfaces.

9. The printing unit of claim 8, where the dehumidifier includes:

a drain; and a gutter under the exterior condensing surfaces of each condensing unit to catch water falling from the exterior condensing surfaces and to carry the water to the drain.

10. The printing unit of claim 9, where exterior condensing surfaces on each condensing unit converge at a low point along a sharp corner from which water drops may fall into the gutter.

11. The printing unit of claim 8, comprising a vacuum duct next to each of the condensing units between adjacent print bars.

12. The printing unit of claim 8, where:

the multiple print bars comprise:

first print bars arranged along an arc on a first side of the printing unit for applying ink to one side of the web; and second print bars arranged along an arc on a second side of the printing unit for applying ink to the other side of the web; and at least one of the condensing units is positioned between adjacent first print bars and at least one of the condensing units is positioned between adjacent second print bars.

13. The printing unit of claim 8, where the condensing units and the chiller have a capacity sufficient to condense at least 20 ml of water per minute collectively on all of the exterior condensing surfaces.

14. The printing unit of claim 8, where each condensing unit and the chiller having a capacity sufficient to condense at least 5 ml of water per minute on the exterior condensing surfaces of each condensing unit.

15. A condensing unit for a dehumidifier for an inkjet printer, comprising exterior condensing surfaces and an interior flow passage extending lengthwise between the exterior condensing surfaces, the exterior condensing surfaces converging at a low point along a sharp corner and each of the condensing surfaces not more than 5 cm wide and having an area of at least 340 $cm^2$.

16. The condensing unit of claim 15, where each exterior condensing surface is formed on a hydrophobic material.

17. The condensing unit of claim 16, where each exterior condensing surface is formed on a hydrophobic material coating a metal substrate.

18. The condensing unit of claim 15, where a first one of the exterior condensing surfaces transitions along a rounded corner before intersecting a second one of the exterior condensing surfaces at the sharp corner.

19. The condensing unit of claim 18, where a broad face of the first one of the exterior condensing surfaces across a width of the condensing unit transitions along the rounded corner to a narrow face across a thickness of the condensing unit.

* * * * *